US006695675B1

(12) United States Patent
Ngan

(10) Patent No.: US 6,695,675 B1
(45) Date of Patent: Feb. 24, 2004

(54) ACCELERATOR FOR TOY VEHICLES HAVING MULTIPLE ENGAGEABLE LEVELS

(75) Inventor: Roger Ngan, Diamond Bar, CA (US)

(73) Assignee: Maisto International, Inc., Fontana, CA (US)

( * ) Notice: Subject to any disclaimer, the term of this patent is extended or adjusted under 35 U.S.C. 154(b) by 0 days.

(21) Appl. No.: 10/455,990

(22) Filed: Jun. 5, 2003

(51) Int. Cl.[7] ..... A63H 29/00
(52) U.S. Cl. ..... 446/429; 446/444
(58) Field of Search ..... 446/429, 430, 446/433, 444, 445, 170, 171, 465

(56) References Cited

U.S. PATENT DOCUMENTS

| | | | |
|---|---|---|---|
| 2,522,160 | A | 9/1950 | Borchers |
| 2,604,055 | A | 7/1952 | Snowden |
| 3,469,340 | A | 9/1969 | Breneman et al. |
| 3,590,524 | A | 7/1971 | Beny et al. |
| 3,599,365 | A | 8/1971 | Carver et al. |
| 3,641,704 | A | 2/1972 | Sims et al. |
| 4,070,024 | A | 1/1978 | Hamano |
| 4,108,437 | A | 8/1978 | DeAnda et al. |
| 4,174,587 | A | 11/1979 | Morin et al. |
| 4,397,465 | A | 8/1983 | Gable |
| 4,403,440 | A | 9/1983 | Wulff |
| 4,425,735 | A | 1/1984 | Kulesza et al. |
| 4,513,967 | A | 4/1985 | Halford et al. |
| 4,519,789 | A | 5/1985 | Halford et al. |
| 4,558,867 | A | 12/1985 | Hippely |
| 4,605,230 | A | 8/1986 | Halford et al. |
| 4,690,658 | A | 9/1987 | Crosson et al. |
| 5,052,972 | A | 10/1991 | Suimon et al. |
| 5,052,973 | A | 10/1991 | Rudell et al. |
| 5,102,133 | A | 4/1992 | Chilton et al. |
| 5,165,347 | A | 11/1992 | Wagner |
| 5,205,554 | A | 4/1993 | Copson |
| 5,234,216 | A | 8/1993 | Ostendorff |
| 5,299,969 | A | 4/1994 | Zaruba |
| 5,433,641 | A | 7/1995 | Rudell et al. |
| 5,800,272 | A | 9/1998 | Pons |
| 5,899,789 | A | 5/1999 | Rehkemper et al. |
| 6,000,992 | A | 12/1999 | Lambert |
| 6,062,942 | A | 5/2000 | Ogihara |
| 6,089,951 | A | 7/2000 | Ostendorff |
| 6,170,754 | B1 | 1/2001 | Halford |
| 6,241,573 | B1 | 6/2001 | Ostendorff et al. |
| 6,435,929 | B1 | 8/2002 | Halford |

*Primary Examiner*—Jacob K. Ackun
*Assistant Examiner*—Jamila Williams
(74) *Attorney, Agent, or Firm*—Donn K. Harms

(57) ABSTRACT

An toy vehicle accelerator adapted for engagement with a roadway forming a track for carrying toy vehicles. The device features a lower first pair of rollers mounted adjacent to a first pathway to provide engagement the sides of a toy vehicle passing between said first pair of rollers. At a second level above the first, a removably mountable second pair of rollers may be mounted to form a second pathway at a second level above said first pathway. The second pair of rollers is rotatable by the same power source as the first allowing for the attachment of one or a plurality of different levels of powered rollers to accelerate toy vehicles on the track.

18 Claims, 3 Drawing Sheets

ACCELERATOR FOR TOY VEHICLES HAVING MULTIPLE ENGAGEABLE LEVELS

FIELD OF THE INVENTION

This invention relates to the field of toy car tracks. More particularly it relates to acceleration devices for such car tracks which have a plurality of levels and directions available to the user through the provision of attachable accelerators at multiple levels which can be positioned to thereby accelerate the toy vehicles in one or a plurality of levels and directions.

BACKGROUND OF THE INVENTION

Toy vehicles such as toy cars which engage and move about toy race tracks are well known in the art. Many such toy vehicle sets with cars and tracks have been produced for kids and adults alike in the last century. Such toy vehicle sets generally use two different types of acceleration means to provide power to the cars on the track to allow them to circumnavigate the track and to allow kids and adults alike, to race their respective vehicles. One type, generally known for years as "slot cars" uses a multiple rail system imbedded in the track which is electrified to communicate electrical power to motors mounted in toy cars which are also engaged in a slot on the track which keeps the cars in registered engagement with the power provided by the energized rails. Slot cars are generally used by older children and adults due to the presence of electricity and the need to engage the track set with AC power to run transformers which deliver power to the energized rails.

The other popular type of toy car race set employs cars which have no onboard motor or engine and move about the track and have no slot to engage the toy cars with the track but instead use a track with side rails to keep the cars on the track so long as they are not over accelerated. Such toy cars generally use inertia of the cars themselves for propulsion around the finite confines of the track. This inertial force is conventionally generated by some type of frictionally or other car engaging device which momentarily engages with the toy car thereby propelling the toy cars down the track. Such propulsion devices include rubber bands, compressed air, gravity, springs engaging push, rails, and rotating wheels which frictionally engage the sides of the vehicles moving about the assembled track.

The rotating wheel form of propulsion has been popular for years to provide the force to propel small toy cars around the finite length of an assembled race track which is dimensioned to maintain the toy cars on the track during positive and negative acceleration around the track. In recent years, with the advent of electronic video games, where participants view a screen and participate in virtual races, toy car sets have suffered a sales decline due to some of the inherent design aspects of such toys and their inability to provide complicated and multiple layer tracks which afford the user challenges in negotiating the course. Most such wheel accelerated race tracks employ a single set of counter rotating wheels which accelerate the toy cars moving between them. However the limitations of the rotating wheel style accelerator being in one place and on a single level of the toy track have limited the size and levels of the race track due to the limited inertia developed by the single level of acceleration. The assembled track which the cars traverse can only be as long and as high as the inertia imparted to the cars will allow since they must be able to make it back to the rotating wheels for more power.

A number of devices have been manufactured or designed in the past to address the need for such acceleration devices.

U.S. Pat. No. 3,641,704 (Sims) teaches an accelerator for unpowered toy vehicles moving along a miniature roadway which employs two lever mounted counter rotating wheels to engage toy cars moving therebetween. Sims however lacks the provision of multiple optionally engageable driving wheels, which the user may attach at different higher levels, which easily and removably engage with the power source driving the first set of wheels. Sims also lacks any provision for using the accelerator both as a crossover to change toy car direction on the track while concurrently providing more acceleration to the car on higher levels.

U.S. Pat. No. 3,590,524 (Beny) also teaches an accelerator for toy cars which provides a plurality of pairs of oppositely turning wheels for engaging toy cars moving on a parallel track. However Beny is limited to the provision of acceleration to the toy cars on a single level and lacks any user engageable drive wheel assemblies which may be engaged at higher levels and driven by the same motor powering the lower level. The track taught by Beny thus limits the height and complexity of the toy track which may be assembled to one that has a length and height traverse which will allow the cars accelerated to make it back to the drive rollers. Tracks at multiple levels which would allow the toy cars to traverse complex turns and heights are severely restricted by Beny since the cars propelled at a rate to stay in the confines of the track would run out of power if taken too high or at elevations and multiple turns on those higher elevations.

As such, there exists a need for a toy car accelerator that will allow for the assembling of simpler or more complicated track assemblies to challenge the player and keep the player interested in the game so that toy tracks become as challenging as the virtual race of video games. Such an accelerator should provide a plurality of levels of car engaging propulsion rollers which can optionally be engaged. Such a device can allow for a single track, or through the provision of multiple pairs of powered rollers, multiple parallel tracks to enliven the race between two or more cars. Such a device with optional engagement or one or more power rollers at one or a plurality of levels would allow small children or new users to assemble a simple track with minimal height and complexity. Concurrently, such a toy car accelerator should provide for the user to attach one or a plurality of additional accelerators to the same power source and move the track surface to ever higher levels to thereby allow for the race track engaging the toy cars to be built taller and more complicated as the user's skills improve. Still further, such an accelerator should optionally be engageable at different levels to accelerate the toy cars in different directions to increase the complexities of track assembly available to the user and provide power to the cars in one or a plurality of directions at one or a plurality of levels of height. Finally, such an accelerator should optionally employ a means to impart multiple levels of acceleration to toy cars moving between the rollers which is user activateable.

SUMMARY OF THE INVENTION

The device herein disclosed is an improved and user customizable toy car accelerator which is adapted for engagement with a track which has walls and surfaces dimensioned to maintain an unpowered toy car during its traverse around the assembled track. In its simplest form the disclosed device features a single track at one level which can be used with one or a plurality of cars. One or a plurality of additional sets of power rollers may be engaged with the lowest level of power rollers to allow for acceleration to occur to the toy vehicle at higher levels. The acceleration at higher levels is powered by the same power supply rotating the rollers at lower levels by cooperative communication therewith through a means of engagement of the upper rollers with the power source of the lower rollers as shown as a hex shaft on the upper rollers engageable with a hex slot communicating with the axle of the lower rollers.

In another favored embodiment, two parallel tracks are provided on the first level for use to provide two separate channels for acceleration of two or more cars moving in the separate channels. Acceleration on the level or levels above is provided by secondary pairs of rotating rollers spaced to engage with the sides of toy cars passing therebetween. The rollers on the higher levels provide a means for acceleration at levels above the lower level and are in the favored embodiment powered by the same power source as the two pair of rollers located on the lowest level. Power to counter rotate the two pair of upper rollers is communicated much the same as the single pair embodiment above in that the rollers on the upper level have a shaft or axle which engages with the rotating shaft or axle of the respective roller located below.

In the simplest form of the single or dual pair of rollers placed above the lower roller accelerators the rollers could simply be engaged on an axle which engages with the axle of the lower roller and essentially plugs into it. Upper portions of track would engage with a mount at the upper level and thereby operatively pass the toy cars through the rollers for acceleration. Or, the upper rollers can also be engaged in a housing that holds them properly spaced and the entire housing holding the two or four upper rollers would engage upon the lower housing holding the lower rollers with the upper rollers engaging the power of the lower rollers. This favored embodiment with the upper housing would allow for easy engagement of the upper power rollers as one or two pairs and hold them in place and also provide the adaptive engagement for one or two tracks above the lower tracks. Also, using the upper housing would allow for the provision of gearing the change the direction of propulsion of the cars passing through the upper track or tracks and make the upper track a crossover, thereby providing another way to complicate the track for the user to provide a more exciting race.

An object of this invention is the provision of a toy car accelerator which allows the user to assemble one or a plurality of additional upper accelerators above the accelerators on a first layer.

Another object of this invention is the provision of such an accelerator which has the upper power rollers engage the same power source rotation as the lower power imparting rollers, thereby simplifying the assembly and manufacture thereof.

An additional object of this invention is the provision of such a toy car accelerator which can provide power toy vehicles on one or a plurality of upper level roadways.

Yet another object of this invention is the provision of a toy car accelerator which provides upper levels of toy acceleration which may attach using a housing which may provide acceleration to the toy cars in a different direction than the lower accelerators.

These together with other objects and advantages which will become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description serve to explain the principles of this invention.

DETAILED DESCRIPTION OF THE PREFERRED EMBODIMENTS

Figure 1:
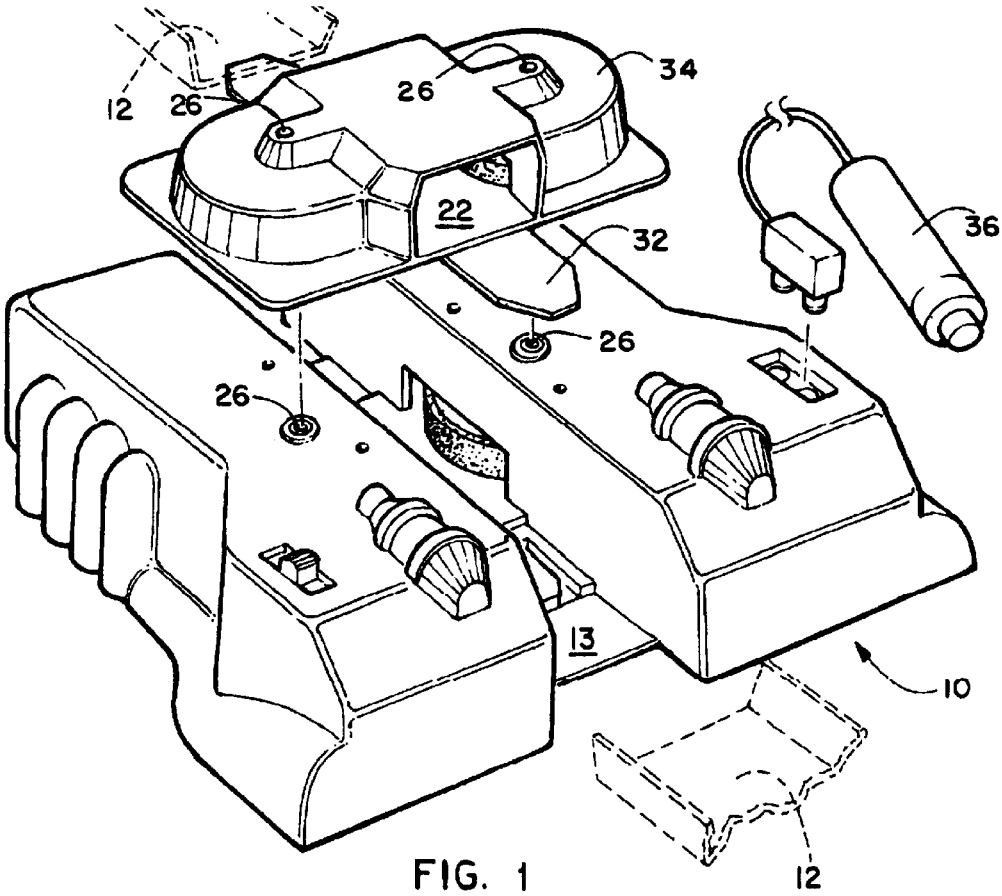
FIG. 1 depicts a perspective view of a single track embodiment of the disclosed device with a single upper accelerator with a housing.

Referring now to drawings 1–4, wherein similar parts of the invention are identified by like reference numerals, there is seen in FIG. 1 the disclosed accelerator 10 which is adapted for engagement with a roadway 12 which is dimensioned to provide a path for a toy car. Such roadways 12 are conventionally formed by a plurality of individual straight and curved pieces of track which interlock and form a circuitous pathway for a toy vehicle to follow.

Along a first pathway at the lowest level is a first pair of rollers 14 and 16 which are rotationally mounted adjacent to the first pathway 13. This first pathway 13 is adapted at an entry and an exit side for engagement with the roadway 12 formed of tracks or similar components. The space between the first set of rollers 14 and 16 is dimensioned to provide engagement of this first pair of rollers upon opposite sides of a toy vehicle 21 passing between this first pair of rollers 14 and 16. The two rollers 14 and 16 are counter rotated by an electric or other motor or other means to impart counter rotation to the two rollers 14 and 16 such that a toy vehicle passing therebetween is accelerated by the rollers 14 and 16.

Also provided is a second pair of rollers 18 and 20 spaced to engage the sides of the toy vehicle 21 when passing therebetween along a second pathway 22. This second pair of rollers 18 and 20 is in the current best mode of the accelerator 10 removably mountable to a position above the first set of rollers 14 and 16 such that the user can easily add the second set of rollers 18 and 20 if desired.

The means for removably mounting this second pair of rollers 18 and 20 elevated above the first pair of rollers 14 and 16 in the simplest mode would be to have an axle 24 engaging the rollers 18 and 20 on one end and having a distal end dimensioned for cooperative engagement with a rotating receiver 26 which can either be connected directly to the first pair of rollers 14 and 16 or the receivers 26 could be engaged with the motor or similar power source using gears independent of the lower rollers 14 and 16. The current best mode of the device which is the simplest to manufacture and employ features a hex or similar shape on the distal ends of the axles 24 which slidably engages with a recess forming the receiver 26 in a distal end of an lower axle 28. In this simple format, the two lower rollers 14 and 16 would be rotationally engaged in a case 30 which would have a center section forming the second path 22 as part of the top of the case 30 and covering the first pathway 13. Means for cooperative engagement with the roadway 12 such as projections 32 would extend from the center section covering the first pathway 13. In this simplest mode of the disclosed device, the user would simply plug the second pair of rollers 18 and 20 into the receivers 26 and attach the roadway to the case 30 which would extend over the first path 13. This would provide the acceleration to the toy vehicle 21 on two different levels and could be easily assembled or disassembled should only one level of acceleration be desired.

Another preferred embodiment is shown in FIG. 1 where the second set of rollers 18 and 20 are rotationally mounted in a frame 34 which would have a portion of the frame 34 extending between the rollers 18 and 20 and forming the second path 22. Of course the frame 34 might leave out the portion extending between the rollers 18 and 20 which could be formed of the top of the case 30 below. As long as the second pathway 22 is provided between the second pair of rollers 18 and 20 and is adapted for engagement at both ends with the roadway 12 this embodiment will provide the extra acceleration at the second level above the first level. The provision of the frame 34 to rotationally mount the second rollers 18 and 20 makes this embodiment easier to use with less chance of losing one of the rollers 18 and 20 since they are permanently mounted in the frame 24 and would line up easily with the receivers 26 below in a registered engagement.

The axles 24 in this embodiment would extend below the frame 34 to allow engagement with the receivers 26, and thus the user when deciding to employ a second path of acceleration would simply take the frame 34 with axles 24 and rollers 18 and 20 rotationally mounted and engage the axles 24 with the receivers 26. This embodiment along with the other embodiments employing a frame 34 to hold the rollers 18 and 20 also allows for "stacking" or adding additional frame mounted rollers 18 and 20 to provide a third level of acceleration with a third pathway and a fourth level of acceleration with a fourth pathway therethrough and so on. Consequently one or a plurality of frames 34 with rollers 18 and 20 could be mounted on top of the next with the axles 24 of the upper frame 34 engaging with the receivers 26 mounted in the frame 34 underneath.

Figure 2:
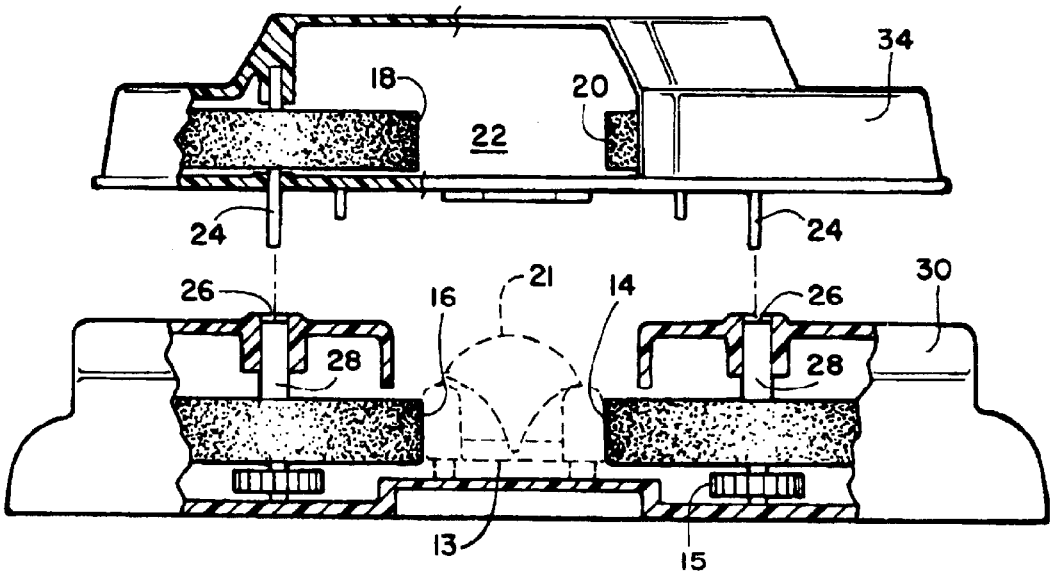
FIG. 2 shows a side cut away view of FIG. 1 showing the engagement of the upper power rollers with the lower rollers and the housing for the upper rollers.

As noted and best shown in FIG. 2, a typical engagement of the upper power rollers 18 and 20 with the lower rollers 14 and 16 engages axles 24 with receivers 26 communicating with the lower rollers 14 and 16 or by geared or other means with the motor or other device providing the rotation. The depicted view of FIG. 2 is probably the simplest construction which would allow transmission of power from the lower level to one or a plurality of engaged upper levels engaged with each other.

Figure 3:
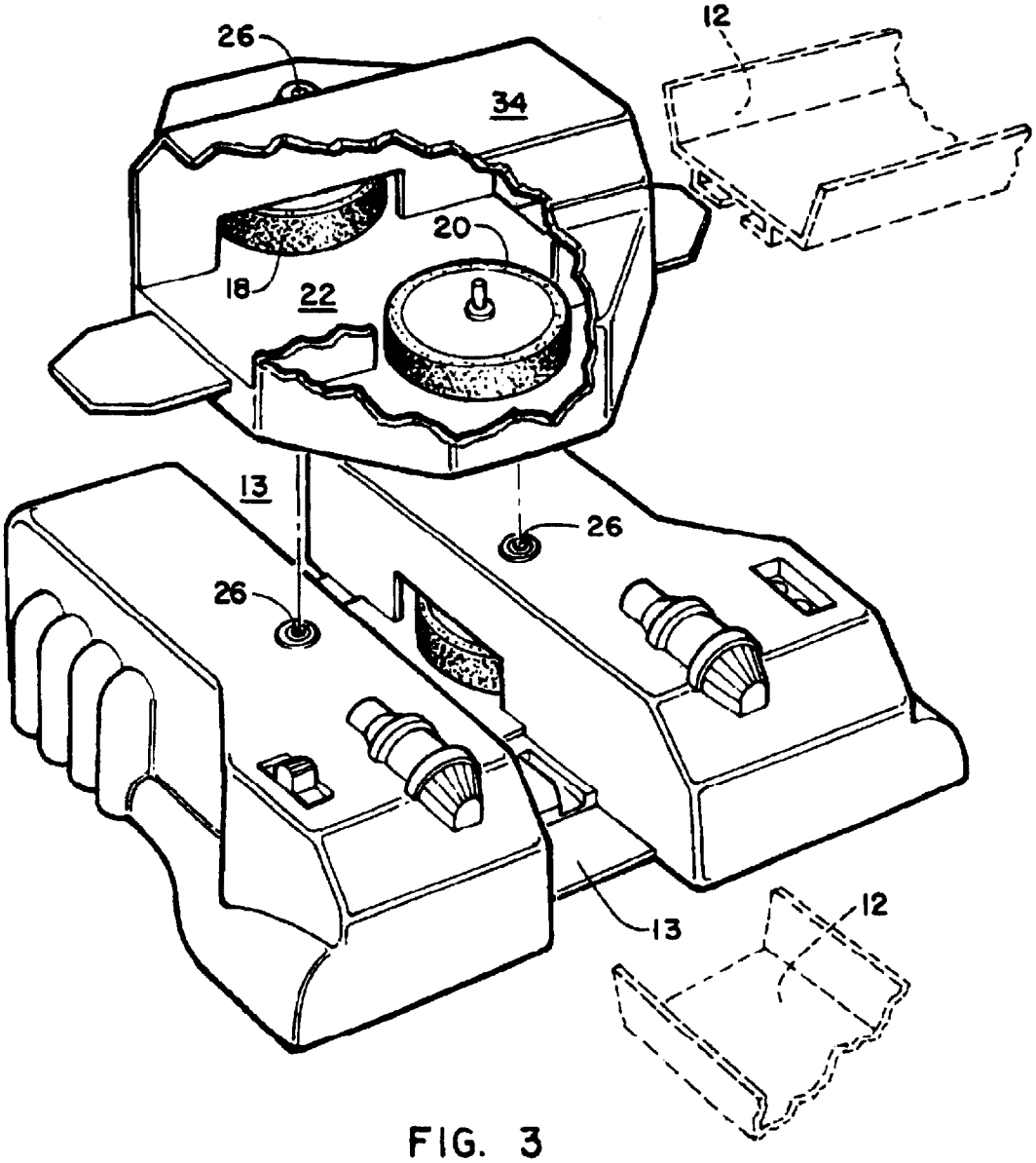
FIG. 3 depicts a view of a multiple track embodiment of the device where two parallel tracks both have multiple levels of acceleration rollers.

An additional preferred embodiment of the disclosed device is shown in FIG. 3 which depicts the frame 34 rotationally engaging the rollers 18 and 20. Gears similar to the gear 15 shown in FIG. 2 or belts (not shown) would engage the axles 24 projecting from the bottom of the frame 34 with the rollers 18 and 20 and allow the second pathway to be at an angle in relation to the first pathway 13. As depicted, the second pathway 22 is substantially perpendicular to the direction of the first pathway 13. However, those skilled in the art will realize that other angles could be obtained by changing the position of the mounting of the rollers 18 and 20 in the frame 34 and communicating rotational power from the receivers 26 to the axles 24 and on to the rollers 18 and 20 using gears or belts or the like. Again, even in this embodiment with the first and second paths at angled over cross, a third or more pathway might be added by the addition of another frame 34 with rollers 18 and 20 mounted in the frame 34 and axles 24 protruding therefrom to engage the receiver 26 communicating with the frame 34 underneath. The addition of ever higher levels with power provided to the toy vehicle 21 is only limited by the amount of power required to spin the various pairs of counter rotating wheels on the different levels. Of course those skilled in the art will realize that motors or similar rotational means of power might be provided in each frame 34 and communicate directly with the rollers 18 and 20. However, the easiest construction which allows for a single speed control would use one motor or rotational power means in the case 30 communicating with both the first pair of rollers 14 and 16 and the second pair of rollers 18 and 20 through the lower axle 28 and receiver 26 or with a geared communication to the receivers 26.

Figure 4:
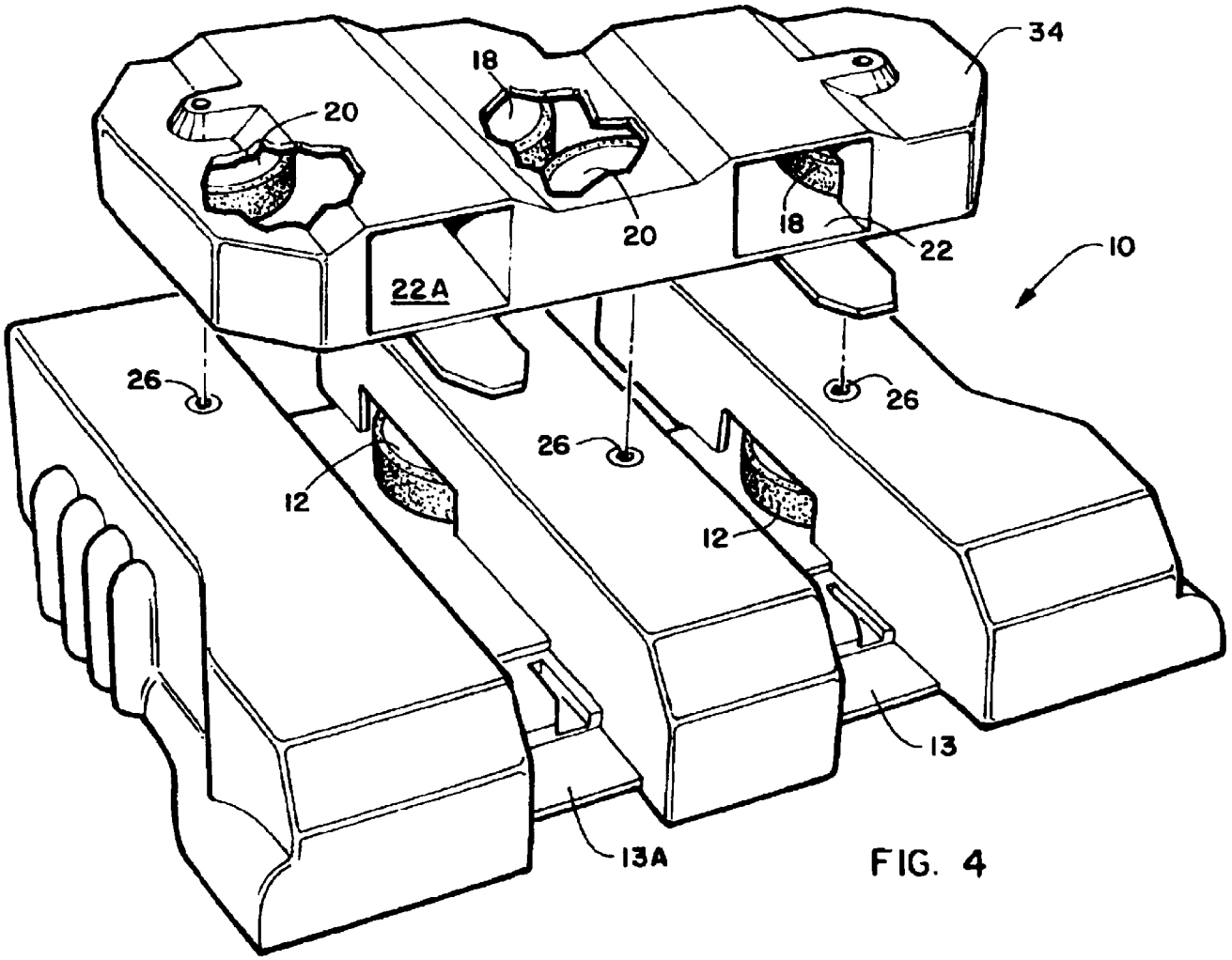
FIG. 4 depicts a perspective view of the disclosed device in which the upper acceleration rollers are engaged with the lower and provide acceleration to cars therethrough at an angle substantially normal to the acceleration direction of the lower rollers.

FIG. 4 depicts an embodiment of the disclosed device which provides for a dual track which would be used when players wish to compete on two tracks forming two roadways 12. This embodiment would function much the same as the above noted single track embodiment and would provide in the simplest form, two pairs of rollers 18 and 20 which would mechanically engage with receivers 26 and rotate above the lower located rollers 14 and 16. Using this embodiment two of the second pathways 22 would be provided above two of the first pathways 13. This embodiment, much like above could also employ a frame 24 to rotationally mount the two pairs of rollers 18 and 20 above the lower located rollers and form the pair of second pathways 22 and 22*a* which would be adapted to cooperatively engage the roadway 12 at each entrance and exit connected by the second pathways 22 and 22*a*. This embodiment would be used where multiple roadways 12 are used as the race track for the toy vehicles 21 and provides a plurality of parallel second pathways 22 and 22*a* which are situated above the first pathways 13 and 13*a*. The upper rollers 18 and 20 would be situated adjacent to both upper or second pathways 22 and 22*a* to provided thrust to the toy vehicles 21 passing in between each such pair of rollers. This embodiment, using the frame 34 to hold the rollers 18 and 20, would allow for easy engagement of the axles 24 driving the rollers with the receivers 26 exposed below. Much like the other embodiments using a frame 34, receivers 26 communicate through the top surface of the frame 34 to provide power to additional frames 34 and rollers 18 and 20 which could be mounted above. This embodiment could also be configured like that of FIG. 2 where the upper pathways are at an angle or perpendicular to the lower pathways to provide a cross over for the roadway 12 forming the race track.

Because of the increased number of rollers 18 and 20 needing counter rotational power, it was found through experimentation that the motor providing power to all of the rollers would provide a better racing experience to the user if a plurality of power levels were provided to be imparted to the toy vehicles 21. In the current embodiments, the motor driving all of the rollers would have at least two power levels. The default power level would spin all of the rollers at a substantially constant speed. However, using the activator 36 which would be wired to control the motor speed, the user could for a duration as long as the activator 36 button is pressed increase the speed of the motor and the rollers. Using the activator 36 players could momentarily increase roller speed when a toy vehicle 21 is approaching a level where the roadway 12 in front of the rollers would allow for the increased acceleration.

The device herein shown in the drawings and described in detail herein discloses arrangements of elements of particular construction and configuration for illustrating preferred embodiments of structure and method of operation of the present invention. It is to be understood, however, that elements of different construction and configuration and other arrangements thereof, other than those illustrated and described, may be employed to provide the toy car accelerator in accordance with the spirit, of this invention. Any and all such changes, alternations and modifications as would occur to those skilled in the art are considered to be within the scope of this invention as broadly defined in the appended claims. Further, while the present invention has been described herein with reference to particular embodiments thereof, a latitude of modifications, various changes and substitutions are intended in the foregoing disclosure, and will be appreciated that in some instance some features of the disclosed invention will be employed without a corresponding use of other features and/or in different combinations with other features without departing from the scope of the invention as set forth in the following claims.

What is claimed is:

1. An accelerator adapted for engagement with a roadway for carrying toy vehicles, comprising:

a first pair of rollers, said rollers mounted adjacent to a first pathway communicating on a first level between said first pair of rollers, said first pathway having an entry and an exit adapted for engagement with said roadway;

said pathway dimensioned to provide engagement of said first pair of rollers upon opposite sides of a toy vehicle passing between said first pair of rollers;

means for counter rotating said first pair rollers;

a second pair of rollers;

a second pathway formed between said second pair of rollers;

means for removably mounting said second pair of rollers elevated above said first pair of rollers with said second pathway at a second level above said first pathway;

said second pathway having two ends, each of said two ends adapted for cooperative engagement with said roadway;

said second pathway dimensioned to provide engagement of said second pair of rollers on opposite sides of said toy vehicle passing between said second pair of rollers; and means for counter rotating said second pair of rollers whereby a vehicle moving along said track is accelerated by both said first set of rollers on said first level and said second pair of rollers on said second level.

2. The accelerator of claim 1, wherein said means for counter rotating said second pair of rollers comprises:

axles communicating on a first end with each of said second pair of rollers; and said axles having a second end adapted for cooperative removable engagement with a receiver powered by said means for counter rotating said first pair rollers, whereby said second pair of rollers may be removably engaged above said first pair of rollers and accelerate said toy vehicle passing therebetween.

3. The accelerator of claim 1, wherein said means for counter rotating said second pair of rollers comprises:

said second pair of rollers mounted in a frame;

at least one axle communicating on a first end with said second pair of rollers;

said at least one axle adapted on a distal end for cooperative removable engagement with a receiver; and said receiver powered by said means for counter rotating said first pair rollers and rotating therewith, whereby said second pair of rollers may be removably engaged above said first pair of rollers and counter rotate using power from at least said one axle and thereby accelerate said toy vehicle passing therebetween.

4. The accelerator of claim 1, wherein said means for counter rotating said second pair of rollers comprises:

said second pair of rollers mounted in a frame;

each of said pair of rollers communicating with a first end of individual axles;

each of said individual axles adapted on a distal end for cooperative removable engagement with a receiver; and said receiver powered by said means for counter rotating said first pair rollers and rotating therewith, whereby said second pair of rollers may be removably engaged above said first pair of rollers and counter rotate using power from at least said one axle and thereby accelerate said toy vehicle passing therebetween.

5. The accelerator of claim 3 additionally comprising:

said frame having a top surface;

an upper receiver communicating through said top surface at one end; and means for engagement of said upper receiver the rotational power provided by said axle whereby said upper receiver rotates when said second pair of rollers rotate and at least one additional pair of rollers may be rotated by said upper receiver in a mount above said second pair of rollers.

6. The accelerator of claim 4 additionally comprising:

said frame having a top surface;

an upper receiver communicating through said top surface at one end; and means for engagement of said upper receiver the rotational power provided by at least one of said axles whereby said upper receiver rotates when said second pair of rollers rotate and at least one additional pair of rollers may be rotated by said upper receiver in a mount above said second pair of rollers.

7. The accelerator of claim 3 additionally comprising:

said second pathway being substantially parallel to said first pathway.

8. The accelerator of claim 3 additionally comprising:

said second pathway being positioned to cross over said first pathway thereby providing a cross over for said roadway.

9. The accelerator of claim 4 additionally comprising:

said second pathway being substantially parallel to said first pathway.

10. The accelerator of claim 4 additionally comprising:

said second pathway being positioned to cross over said first pathway thereby providing a cross over for said roadway.

11. The accelerator of claim 1 additionally comprising:

a third set of rollers;

said third pair of rollers adjacent to a third pathway;

a second pathway formed between said second pair of rollers;

means for removably mounting said third pair of rollers elevated above said first pair of rollers with said third pathway at at substantially said second level above said first pathway;

said third pathway having two ends, each of said two ends adapted for cooperative engagement with said roadway;

said third pathway dimensioned to provide engagement of said third pair of rollers on opposite sides of said toy vehicle passing between said third pair of rollers; and means for counter rotating said second pair of rollers and said third pair of rollers whereby a vehicle moving along said track is accelerated by both said first set of rollers on said first level and said second pair of rollers on said second level, and said third set of rollers on said second level.

12. The accelerator of claim 11, wherein said means for counter rotating said second pair of rollers and said third pair of rollers comprises:

axles communicating on a first end with each of said second pair of rollers and said third pair of rollers; and said axles having a second end adapted for cooperative removable engagement with a receiver powered by said means for counter rotating said first pair rollers, whereby said second pair of rollers and said third pair of rollers may be removably engaged above said first pair of rollers and accelerate said toy vehicle passing therebetween.

13. The accelerator of claim 11, wherein said means for counter rotating said second pair of rollers and said third pair of rollers comprises:

said second pair of rollers mounted in a frame;

said third pair of rollers mounted in said frame;

at least one axle communicating on a first end with said second pair of rollers and said third pair of rollers;

said at least one axle adapted on a distal end for cooperative removable engagement with a receiver; and said receiver powered by said means for counter rotating said first pair rollers and rotating therewith, whereby said second pair of rollers and said third pair of rollers may be removably engaged above said first pair of rollers and counter rotate using power from at least said one axle and thereby accelerate said toy vehicle passing therebetween.

14. The accelerator of claim 13 additionally comprising:

said second pathway being positioned to cross over said first pathway thereby providing a cross over for said roadway.

15. The accelerator of claim 4 additionally comprising:

said second pathway and said third pathway being substantially parallel to said first pathway.

16. The accelerator of claim 1 additionally comprising:

said means for counter rotating said first pair rollers having at least two rotational speeds; and button activateable means to switch between said two rotational speeds.

17. The accelerator of claim 1 additionally comprising:

said means for counter rotating said first pair rollers having at least two rotational speeds; and button activateable means to switch between said two rotational speeds.

18. The accelerator of claim 3 additionally comprising:

said means for counter rotating said first pair rollers having at least two rotational speeds; and button activateable means to switch between said two rotational speeds.

* * * * *